United States Patent [19]

Panaro

[11] 4,124,837

[45] Nov. 7, 1978

[54] CAPACITOR FUSE AND METHOD OF MANUFACTURING A PART THEREOF

[75] Inventor: Robert J. Panaro, Byfield, Mass.

[73] Assignee: Gould Inc., Rolling Meadows, Ill.

[21] Appl. No.: 816,156

[22] Filed: Jul. 15, 1977

[51] Int. Cl.[2] ..... H01H 85/22

[52] U.S. Cl. ..... 337/251; 335/235

[58] Field of Search ..... 337/251, 235, 248, 228, 337/186; 338/274

[56] References Cited

U.S. PATENT DOCUMENTS

| | | | |
|---|---|---|---|
| 2,315,311 | 3/1943 | Brown | 337/251 |
| 2,586,171 | 2/1952 | McMahon | 337/251 |
| 2,794,099 | 5/1957 | Swain | 337/251 |

*Primary Examiner*—Harold Broome
*Attorney, Agent, or Firm*—Erwin Salzer

[57] ABSTRACT

Capacitor fuses differ from fuses intended for other purposes by the nature of their terminal elements. Their terminal elements must be adapted to be gripped by wrenches and hence be hexagonal in cross-section. Disclosed is a capacitor fuse having hexagonal elements press-fitted upon the ferrules of a fuse, the length of ferrule-receiving cavities in said hexagonal elements being substantially equal to the length of the ferrules of the fuse. One of the hexagonal elements is provided with an internally screw-threaded bore and the other of said hexagonal elements is provided with an externally screw-threaded projection extending in a direction away from said casing of the fuse.

3 Claims, 11 Drawing Figures

FIG. 1
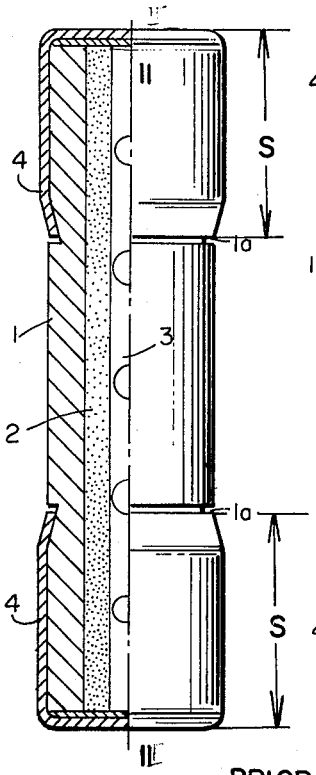
FIG. 2
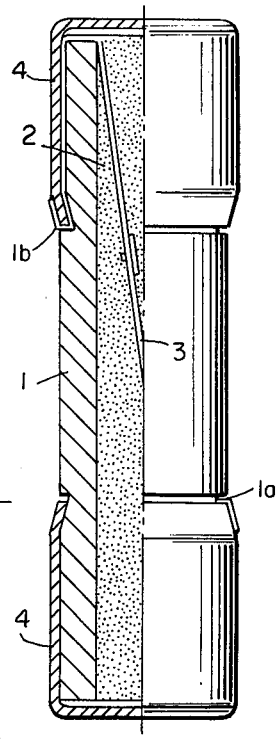
PRIOR ART
FIG. 3a
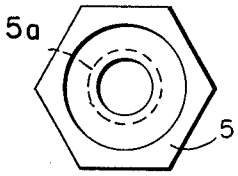
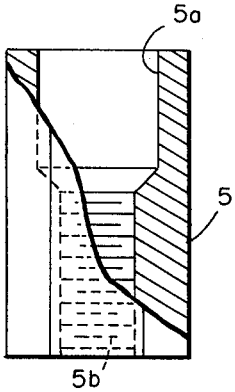
FIG. 3b
FIG. 4a
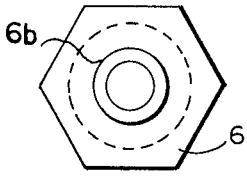
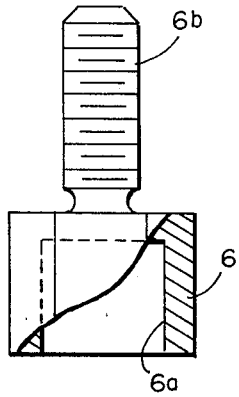
FIG. 4b
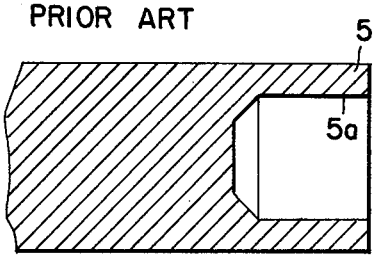
FIG. 5a
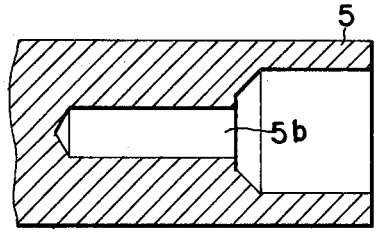
FIG. 5b
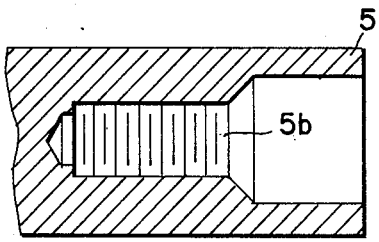
FIG. 5c
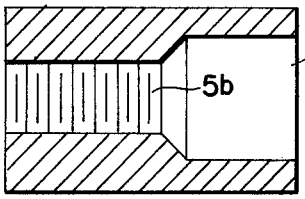
FIG. 5d
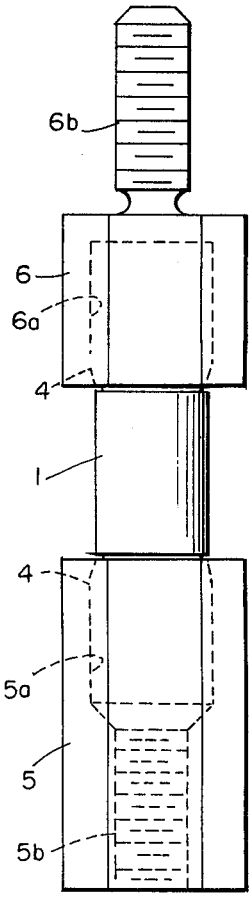
FIG. 6

CAPACITOR FUSE AND METHOD OF MANUFACTURING A PART THEREOF

BACKGROUND OF THE INVENTION

Fuses for the protection of capacitors must be provided with terminals enabling such fuses to cooperate with existing terminals such as, for instance, an externally screw-threaded rod and an internally screw-threaded cavity. Some of the fuses do not differ from standard fuses used for other applications, except in regard to the terminal elements thereof. In view of this situation it became general practice in cases where standard fuses could be used for capacitor protection to affix the required terminals to the ferrules of the standard fuses. This method caused more harm than the good it did, principally because of the difficulties in properly aligning the ferrules with the screw-threaded terminals. Another serious drawback of the above practice is that the overall length of the fuses is unduly increased since the screw-threaded terminals sit, so to speak, on the ferrules of the fuse and thus unduly extend the length of the fuse structure.

The invention is intended to eliminate, and does eliminate, these drawbacks.

SUMMARY OF THE INVENTION

Fuses embodying this invention have a first externally hexagonal element having a first cylindrical cavity press-fitted by means of said cavity on one of the ferrules of a fuse, said first hexagonal element having an internally screw-threaded bore. Fuses embodying this invention further include a second hexagonal element having a second cylindrical cavity press-fitted by means of said cavity on the other of the ferrules of the fuse, said second hexagonal element having an externally screw-threaded stud projecting in a direction away from said casing of said fuse.

BRIEF DESCRIPTION OF THE DRAWINGS

FIG. 1 is partly a front elevation and partly a vertical section of a prior art fuse to be used in connection with capacitors;

FIG. 2 is partly a front elevation and partly a vertical section of the fuse of FIG. 1 taken along II—II of FIG. 1;

FIGS. 3*a* and 3*b* show one of the hexagonal elements according to this invention in top plan view, and partly in front elevation and in vertical section, respectively;

FIGS. 4*a* and 4*b* show the other of the hexagonal elements according to this invention in top plan view partly in front elevation and in vertical section, respectively;

FIGS. 5*a*–5*d* illustrate five consecutive steps in manufacturing the structure of FIGS. 3*a* and 3*b*; and FIG. 6 is a front elevation of a complete fuse embodying the present invention.

DESCRIPTION OF PREFERRED EMBODIMENT

Referring now to the drawings, numeral 1 has been applied to indicate a tubular casing of electric insulating material that is filled with a granular or pulverulent arc-quenching filler 2. Casing 1 is closed by a pair of ferrules 4 whose axially inner ends are crimped into casing 1. Fusible element 3 is arranged inside of casing 1 and embedded in filler 2. Its ends are turned around the rim of casing 1 and spot-welded at 1*b* to the two ferrules 4. A first externally hexagonal element 5 having a first cylindrical cavity 5*a* is press-fitted by means of said cavity 5*a* on one of the pair of ferrules 4. Element 5 has an internally screw-threaded bore 5*b*. The length of cavity 5*a* is such that the axially inner end of said hexagonal element 5 are substantially coextensive with the axially inner end of one of said pair of ferrules 4 when mounted thereon. This is apparent from FIG. 6 but not from the other figures because these are drawn on a different scale. The fact that the depth of cavity 5*a* is equal to the length S of ferrules 4 tends to maximize the alignment of parts 5, 4 and, by hiding the ferrule 4, improves the appearance of the structure. The second externally hexagonal element 6 has a second cylindrical cavity 6*a* and is press-fitted by means of said cavity on the other of the pair of ferrules 4 and has an externally screw-threaded stub 6*b* projecting in the direction away from casing 1. The length S of cavity 6*a* is such that the axially inner end of said hexagonal element 6 is substantially coextensive with the axially inner end of one of said pair of ferrules 4. This is not apparent from FIGS. 1, 2, 3*a*, 3*b*, 4*a*, 4*b* which are drawn on a different scale than FIG. 6, but is fully apparent from FIG. 6. The design of FIG. 6 tends to maximize the alignment of parts 6, 4 and hides ferrule 4 from sight and thus improves the appearance of the structure.

The internal bores 5*a*, 5*b* extend all the way through said first externally hexagonal member 5 from one end surface thereof to the other end surface thereof. This allows to manufacture part 1 as indicated in FIGS. 5*a*–5*d* without removing the same from the chuck in which it is clamped.

According to FIG. 5*a* a bar hexagonal in cross-section is clamped in a chuck and counterbored axially with a tool of relatively large diameter thus producing the cavity 5*a*. Thereupon while the workpiece is still clamped in said chuck the counterbore is extended in axial direction with a tool of relatively small diameter. This has been indicated in FIG. 5*b*. Thereupon cavity 5*b* is tapped or internally screw-threaded as indicated in FIG. 5*c*. The last step consists in cutting the bar at 90° to its longitudinal axis at the end of screw-threaded duct 5*b*, as indicated at 5*d*.

I claim as my invention:

1. A capacitor fuse comprising (a) a casing of electric insulating material, a granular arc-quenching filler inside said casing, a fusible element inside said casing embedded in said filler and a pair of ferrules conductively interconnected by said fusible element and mounted on the ends of said casing;

(b) a first externally hexagonal element having a first cylindrical cavity press-fitted by means of said cavity on one of said pair of ferrules and having an internally screw-threaded bore; and (c) a second externally hexagonal element having a second cylindrical cavity press-fitted by means of said cavity on the other of said pair of ferrules and having an externally screw-threaded stud projecting in a direction away from said casing.

2. A fuse as specified in claim 1 wherein said axially inner ends of said first and said second hexagonal element are substantially coextensive with the axially inner ends of said pair of ferrules.

3. A fuse as specified in claim 1 wherein said internal bore extends all the way through said first externally hexagonal member from one end surface thereof to the end surface of said cylindrical cavity therein.

* * * * *